US007617554B2

(12) United States Patent
Wilkinson

(10) Patent No.: US 7,617,554 B2
(45) Date of Patent: Nov. 17, 2009

(54) PRESSURE EQUALIZATION APPARATUS

(75) Inventor: John W. Wilkinson, Bennington, VT (US)

(73) Assignee: M.P.L. Ltd., Belize (BZ)

( * ) Notice: Subject to any disclaimer, the term of this patent is extended or adjusted under 35 U.S.C. 154(b) by 564 days.

(21) Appl. No.: 10/268,317

(22) Filed: Oct. 10, 2002

(65) Prior Publication Data

US 2004/0068801 A1 Apr. 15, 2004

(51) Int. Cl.
*A47C 27/10* (2006.01)

(52) U.S. Cl. ..... 5/713; 5/710; 5/655.3

(58) Field of Classification Search ..... 5/713, 5/710, 655.3

See application file for complete search history.

(56) References Cited

U.S. PATENT DOCUMENTS

| | | | | |
|---|---|---|---|---|
| 4,662,012 | A | 5/1987 | Torbet | |
| 4,686,722 | A | 8/1987 | Swart | |
| 4,797,962 | A | 1/1989 | Goode | |
| 5,090,076 | A | 2/1992 | Guldager | |
| 5,090,077 | A | 2/1992 | Caden et al. | |
| 5,189,742 | A * | 3/1993 | Schild | 5/713 |
| 5,249,318 | A | 10/1993 | Loadsman | |
| 5,267,364 | A | 12/1993 | Volk | |
| 5,375,273 | A | 12/1994 | Bodine, Jr. et al. | |
| 5,487,196 | A | 1/1996 | Wilkinson et al. | |
| 5,539,942 | A | 7/1996 | Melou | |
| 5,542,136 | A | 8/1996 | Tappel | |
| 5,560,057 | A | 10/1996 | Madsen et al. | |
| 5,586,346 | A | 12/1996 | Stacy et al. | |
| 5,594,963 | A | 1/1997 | Berkowitz | |
| 5,603,131 | A * | 2/1997 | DeJean, Jr. | 5/672 |
| 5,611,096 | A | 3/1997 | Bartlett et al. | |
| 5,630,237 | A | 5/1997 | Ku | |
| 5,634,225 | A | 6/1997 | Miller, Sr. et al. | |
| 5,659,908 | A | 8/1997 | Nishino | |
| 5,699,570 | A | 12/1997 | Wilkinson et al. | |
| 5,701,622 | A | 12/1997 | Biggie et al. | |
| 5,787,531 | A | 8/1998 | Pepe | |
| 5,794,288 | A | 8/1998 | Soltani et al. | |
| 5,873,137 | A | 2/1999 | Yavets-Chen | |
| 5,983,429 | A | 11/1999 | Stacy et al. | |
| 6,014,784 | A | 1/2000 | Taylor et al. | |
| 6,269,505 | B1 * | 8/2001 | Wilkinson | 5/713 |
| 6,564,411 | B2 * | 5/2003 | Pirzada | 5/713 |

* cited by examiner

*Primary Examiner*—Fredrick Conley
(74) *Attorney, Agent, or Firm*—Schmeiser, Olsen & Watts

(57) ABSTRACT

An equalizing pressure control system for connection to at least two pressure zones of a body support. The equalizing pressure control system ensures that an object will be slowly and safely lowered to a static position in the event of a sudden failure of an external pump or a supply pressure to the at least two pressure zones.

29 Claims, 5 Drawing Sheets

PRESSURE EQUALIZATION APPARATUS

FIELD OF THE INVENTION

The present invention relates to an equalizing pressure control system for slowly and safely lowering a patient to a stable position in the event that a powered supply pressure fails or is turned off.

BACKGROUND OF THE INVENTION

Heretofore, inflatable cushioning devices for use with body supports, such as a mattress, sofa, seat, or the like, typically included a plurality of air cells or bladders that are inflated to support a person. The air cells provide support to the person, and can be inflated to a desired pressure level to provide the person with a predetermined level of comfort and support.

In the medical field, cushioning devices including a plurality of air cells are often used to provide different levels of support under various portions of a patient's body. For example, a mattress may include separate air cells located in the upper, middle, and lower portions of the mattress. These air cells can be inflated to different pressures to support the upper, middle, and lower portions of the patient's body with different pressures.

An external pump may cyclically inflate a plurality of air cells for providing alternating pressure therapy for a patient. The external pump may also provide supply pressure to inflate for providing tilting of the patient. In the event of a pump failure, the sudden termination of the supply pressure can result in an abrupt lowering of the patient.

Accordingly, there exists a need to arrive at an adequate pressure equalization device, and a body support utilizing such a device in the event of a pressure supply failure.

SUMMARY OF THE INVENTION

The present invention provides an equalizing pressure control system for connection to at least two pressure zones of a body support. The equalizing pressure control system ensures that a patient will be slowly and safely lowered to a static position in the event of a sudden failure of an external pump or a supply pressure to the pressure zones. The pressure zones may provide alternating lifting under a patient or may provide lifting for tilting a patient.

The first general aspect of the present invention provides an apparatus comprising: a first flow restrictor operatively positioned between at least two pressure zones for restricting a flow of fluid between the at least two pressure zones; a second flow restrictor connecting the first flow restrictor with a pressure relief valve, and wherein the second flow restrictor provides a greater flow resistance to the fluid than the first flow restrictor, and wherein the pressure relief valve selects a level of fluid pressure in the at least two pressure zones.

The second general aspect of the present invention provides a body support comprising: a plurality of fluid cells; a plurality of manifold systems, each with an interconnected group of fluid cells; an alternating fluid pressure system applying alternating fluid pressure to the manifold systems; an equalizing pressure control system controlling the fluid pressure in the manifold systems when the alternating fluid pressure is removed, wherein the equalizing pressure control system equalizes the fluid pressure in each manifold system to a selected pressure level and includes at least one flow restrictor that allows fluid to flow in both directions.

The third general aspect of the present invention provides a body support comprising: a plurality of bladders; a supply apparatus for supplying a pressurized fluid to each bladder; an equalizing pressure control system for controlling the pressurized fluid in the plurality of bladders when the supply apparatus is removed or shut off, wherein the equalizing pressure control system equalizes the fluid pressure in each bladder to a selected pressure level.

The fourth general aspect of the present invention provides a method comprising the steps of: providing a first fluid cell filled with a fluid at a first fluid pressure level; providing a second fluid cell filled with the fluid at a second fluid pressure level; equalizing the fluid pressure between the first fluid cell and the second fluid cell to a third pressure level; and adjusting the third pressure level to a fourth pressure level.

The fifth general aspect of the present invention provides an apparatus comprising: at least two manifold systems, each with an interconnected set of fluid cells; a supply apparatus for supplying pressurized fluid to each interconnected set of fluid cells; and an equalizing pressure control system operatively interconnected with the at least two manifold systems for equalizing the fluid pressure in each fluid cell.

BRIEF DESCRIPTION OF THE DRAWINGS

The features of the present invention will best be understood from a detailed description of the invention and an embodiment thereof selected for the purposes of illustration and shown in the accompanying drawings in which.

DETAILED DESCRIPTION OF THE INVENTION

Figure 1:
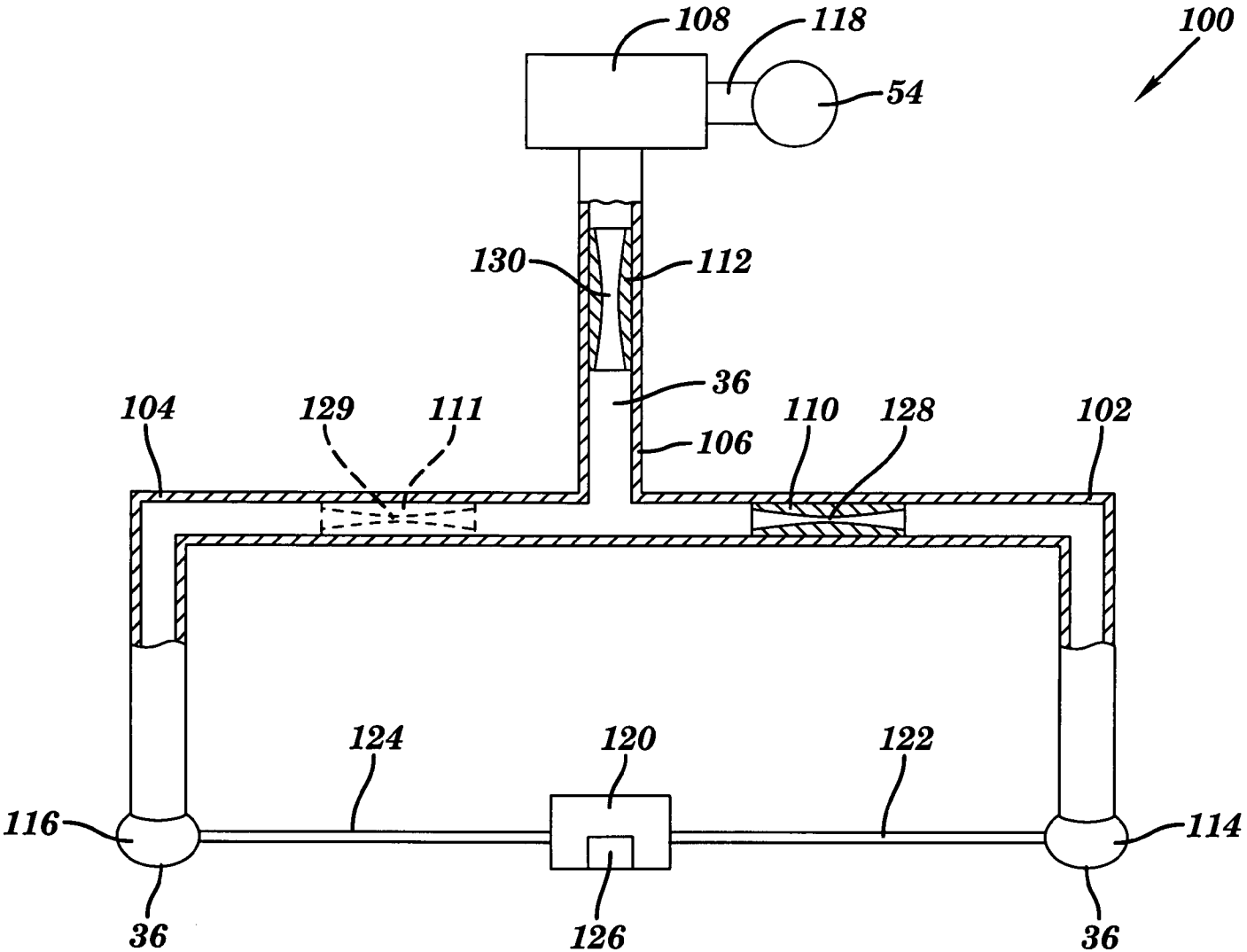
FIG. 1 illustrates a partial cross sectional view of an equalizing pressure control system.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of the preferred embodiment. The features and advantages of the present invention are illustrated in detail in the accompanying drawings, wherein like reference numerals refer to like elements throughout the drawings. Although the drawings are intended to illustrate the present invention, the drawings are not necessarily drawn to scale.

An equalizing pressure control system 100 is illustrated in FIG. 1. The equalizing pressure control system 100 includes a first conduit 102, a second conduit 104, a third conduit 106, a pressure relief valve 108, a first flow restrictor 110, and a second flow restrictor 112. The first conduit 102 connects a first pressure zone 114 with the second conduit 104 and the third conduit 106. The second conduit 104 connects a second pressure zone 116 with the first conduit 102 and the third conduit 106. The first flow restrictor 110 is placed in the first conduit 102. The second flow restrictor 112 is placed in the third conduit 106. The pressure relief valve 108 includes an outlet conduit 118 connected to the fluid exhaust reservoir 54. Generally, the fluid 36 included in the fluid exhaust reservoir 54 is atmospheric air, however, any suitable fluid 36 (e.g., water, nitrogen, etc.) can be used.

Typically, the first pressure zone 114 and the second pressure zone 116 may include fluid 36 pressures that are different from each other. A pressurized fluid supply source 120 may supply pressurized fluid 36 through a conduit 122 to the first pressure zone 114. Additionally, the pressurized fluid supply source 120 may supply pressurized fluid 36 through a conduit 124 to the second pressure zone 116. A control system 126 controls the pressurized fluid 36 delivered to the first pressure zone 114 and the second pressure zone 116. The pressurized fluid supply source 120 may supply alternating high and low pressure fluid 36 to the first pressure zone 114 and to the second pressure zone 116. For example, a high pressure fluid 36 may be supplied through the conduit 122 to the first pressure zone 114, and a low pressure fluid 36 may be supplied through the conduit 124 to the second pressure zone 116. Next, a low pressure fluid 36 may be supplied through the conduit 122 to the first pressure zone 114, and a high pressure fluid 36 may be supplied through the conduit 124 to the second pressure zone 116.

The alternating fluid 36 flow provided by the pressurized fluid supply 120 to the first pressurized zone 114 and to the second pressurized zone 116 is higher than the flow passing between the first pressurized zone 114 and the second pressurized zone 116 through the first flow restrictor 110. The first flow restrictor 110 may restrict flow by any suitable means that allows fluid to flow in both directions (e.g., orifice, porous material, etc.). Preferably, the first flow restrictor 110 has a flow diameter 128 of about 0.016 inches. The alternating fluid 36 flow provided by the pressurized fluid supply 120 to the first pressurized zone 114 and to the second pressurized zone 116 is higher than the flow passing out through the second flow restrictor 112. The second flow restrictor 112 may restrict flow by any suitable means that allows fluid to flow in both directions (e.g., orifice, porous material, etc.). Preferably, the second flow restrictor 112 has a flow diameter 130 of about 0.004 inches. The second flow restrictor 112 has a flow diameter 130 smaller than the flow diameter 128 of the first flow restrictor 110. Therefore, while pressurized alternating fluid 36 flow is being supplied to the first pressure zone 114 and the second pressure zone 116, the flow between the first pressure zone 114 and the second pressure zone 116, through the first flow restrictor 110 and the second flow restrictor 112, is so small that there is a negligible effect on the differential pressure between the first pressure zone 114 and the second pressure zone 116.

If the pressurized fluid supply 120 should be turned off or should fail, the fluid 36 will slowly flow between the first pressure zone 114 and the second pressure zone 116 through the first flow restrictor 110. The second flow restrictor 112 has a much smaller flow diameter 130 than the first flow diameter 110 so that the pressure in the first pressure zone 114 and the second pressure zone 116 will essentially equalize. Then, the fluid 36 slowly passes through the second flow restrictor 112, through the pressure relief valve 108, and through the outlet conduit 118 to the fluid exhaust reservoir 54. The pressure relief valve 108 determines the final pressure level of the fluid 36. The pressure setting of the pressure relief valve 108 may be previously determined or may be manually selected. Thus, if the pressurized fluid supply 120 is turned off, the equalizing pressure control system 100 will equalize the pressure between the first pressure zone 114 and the second pressure zone 116 and will control the final pressure to a selected level. Therefore, a patient resting upon the first pressure zone 114 and the second pressure zone 116 will be slowly and safely lowered to a stable level position at a selected support pressure.

The pressurized fluid supply source 120 may supply a steady pressure fluid 36 to the first pressure zone 114 and to the second pressure zone 116. For example, the first pressure zone 114 may be supplied a steady high pressure fluid 36, while the second pressure zone 116 may be supplied a steady low pressure fluid 36. The steady high pressure fluid 36 may be used to tilt a patient resting upon the first pressure zone 114 and the second pressure zone 116. The patient will tilt from the first pressure zone 114 toward the second pressure zone 116. In the event of turning off or the failure of the pressurized fluid supply 120, the patient will be slowly and safely lowered to a stable level position in a manner similar to that described above. The equalizing pressure control system 100 will equalize the pressure between the first pressure zone 114 and the second pressure zone 116 and will control the final pressure to a selected level.

Another embodiment of the equalizing pressure control system 100 includes the addition of a third flow restrictor 111 (shown in phantom) in FIG. 1. The third flow restrictor 111 is in the second conduit 104. The third flow restrictor may restrict flow by any suitable means (e.g., orifice, porous material, etc.). Preferably, the third flow restrictor 111 includes a flow diameter 129 of about 0.016 inches. If the pressurized fluid supply 120 should be turned off or should fail, the fluid 36 will slowly flow between the first pressure zone 114 and the second pressure zone 116 through the first flow restrictor 110 and the third flow restrictor 111. The second flow restrictor 112 has a much smaller flow diameter 130 than the first flow diameter 110 and the third flow diameter 129, so that the pressure in the first pressure zone 114 and the second pressure zone 116 will essentially equalize. Then, the fluid 36 slowly passes through the second flow restrictor 112, through the pressure relief valve 108, through the outlet conduit 118, and into the exhaust reservoir 54. The pressure relief valve 108 determines the final pressure level of the fluid 36. The pressure setting of the pressure relief valve 108 may be previously selected or may be manually selected. Thus, if the pressurized fluid supply 120 is turned off, the equalizing pressure control system 100 will equalize the pressure between the first pressure zone 114 and the second pressure zone 116 and will control the final pressure to a selected level. Therefore, a patient resting upon the first pressure zone 114 and the second pressure zone 116 will be slowly and safely lowered to a level position with a selected support pressure.

Figure 2:
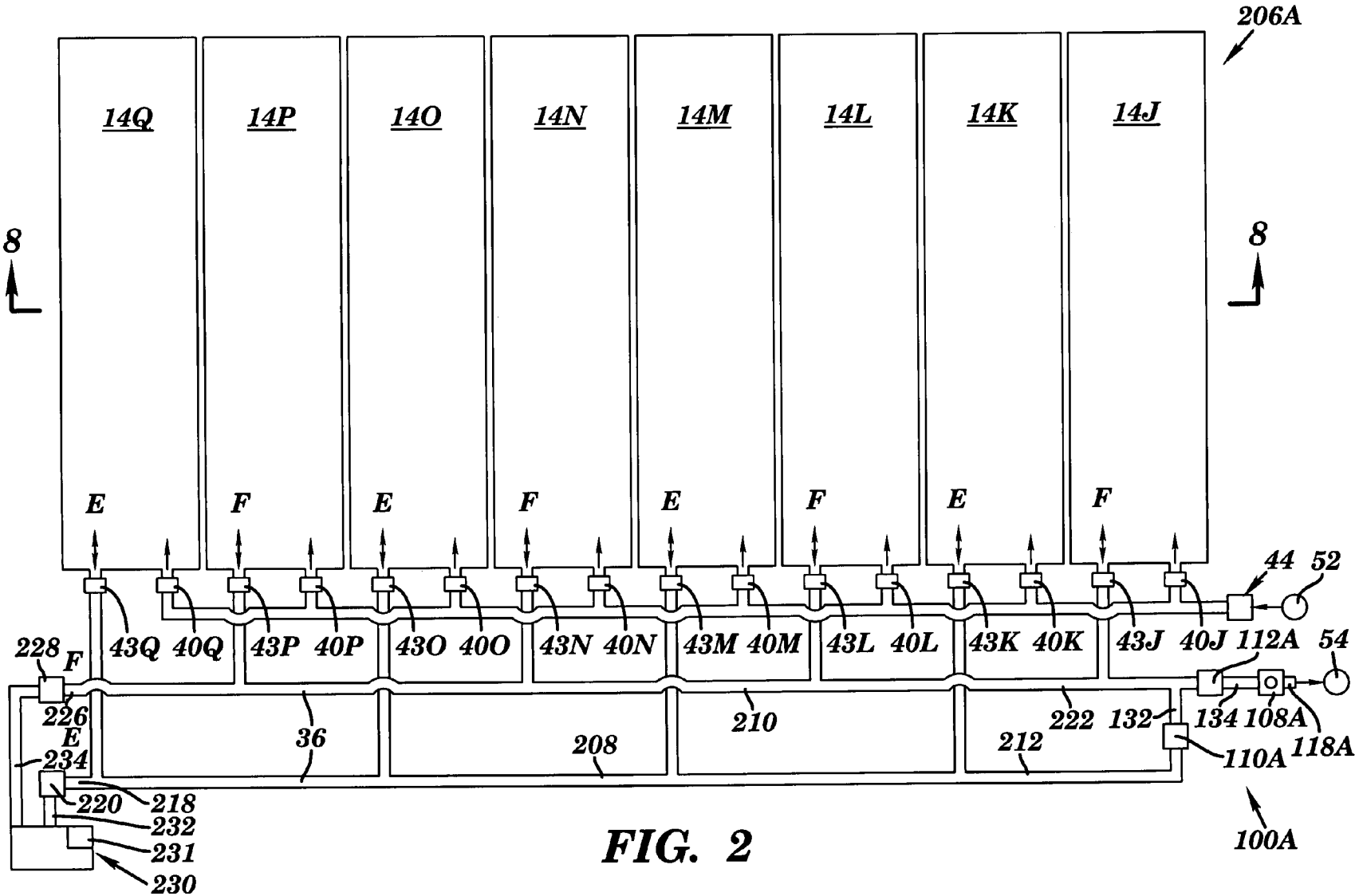
FIG. 2 illustrates a plan view of another embodiment of the support system apparatus including the equalizing pressure control system.

FIG. 2 illustrates a plan view of another embodiment of the support system apparatus 206A. The support system apparatus 206A includes an equalizing pressure control system 100A which will equalize the pressurized fluid 36 between the support zones "E" and "F", in the event that the alternating pressure system 230, which supplies alternating high and low pressure fluid 36 to conduits 208 and 210, is turned off or fails. When conduit 232 is connected to shut off valve 220, and conduit 234 is connected to shut off valve 228, the alternating pressure is supplied to conduits 208 and 210. The conduits 208 and 210 supply the alternating fluid 36 to pressure zones "E" and "F." The alternating pressure system 230 can include any means for supplying the fluid 36 under pressure including a pump, compressor, etc. Also, included in the alternating pressure system 230 is any means such as a valve (not shown) for periodically switching the pressurized fluid 36 between conduit 232 and 234. Each support zone "E" and "F," comprises at least one support cell 14, optionally comprising a deformable or elastic material. Each support cell 14 includes at least one intake valve 40 and at least one port 43. Each intake valve 40 includes a check valve (not shown) allowing fluid 36 to flow into the support cell 14, while preventing fluid 36 from flowing out of the support cell 14. Each port 43 allows unimpeded fluid 36 flow into or out of the support cell 14. Each intake valve 40J-4Q is connected to the intake control system 44, which is connected to the fluid supply reservoir 52. Generally, the fluid 36 included in the fluid supply reservoir 52 is atmospheric air, however, any other suitable fluids can be used.

The ports 43Q, 43O, 43M, and 43K in zone "E" are connected to conduit 208. The ports 43J, 43L, 43N, and 43P in zone "F" are connected to conduit 210. The equalizing pressure control system 100A includes a first flow restrictor 110A, a second flow restrictor 112A, and a pressure relief valve 108A, and an outlet conduit 118A. The first end 212 of conduit 208 is connected to the first flow restrictor 110A. The first end 222 of conduit 210 is connected to the second flow restrictor 112A. A conduit 132 connects the second flow restrictor 112A with the first end 222 of the conduit 210. A conduit 134 connects the second flow restrictor 112A with the pressure relief valve 108A. The outlet conduit 118A connects the pressure relief valve 108A with the exhaust reservoir 54. The pressure control level of the pressure relief valve 108A may be manually adjusted or may be preselected.

The shut off valve 220 can be a "quick disconnect" type that allows fluid 36 to flow through the shut off valve 220 when the conduit 232 is connected, and prevents any flow of the fluid 36 when the conduit 232 is disconnected. The shut off valve 228 can also be a "quick disconnect" type that allows fluid 36 to flow through the shut off valve 228 when the conduit 234 is connected, and prevents any flow of the fluid 36 when the conduit 234 is disconnected.

The alternating fluid 36 flow provided by the alternating pressure system 230 to pressure zones "E" and "F" is much higher than the flow passing between the pressure zones "E" and "F" through the first flow restrictor 110A. The alternating fluid 36 flow provided by the alternating pressure system 230 is much higher than the flow passing out through the second flow restrictor 112A. Preferably, the first flow restrictor 110A has a flow diameter of about 0.016 inches. The second flow restrictor 112A preferably has a flow diameter of about 0.004 inches. The second flow restrictor 112A has a flow diameter smaller than the flow diameter of the first restrictor 110A. Therefore, while pressurized alternating fluid 36 flow is being supplied between pressure zone "E" and pressure zone "F," the flow through the first flow restrictor 110A and the second flow restrictor 112A is so small that there is a negligible effect on the differential pressure between the pressure zone "E" and the pressure zone "F."

If the alternating pressure system 230 should be turned off or should fail, the fluid 36 will slowly flow through the first flow restrictor 110A between the pressure zone "E" and the pressure zone "F." The second flow restrictor 112A has a much smaller flow diameter than the flow diameter of restrictor 110A, so that the pressure in the pressure zone "E" and the pressure in the pressure zone "F" will essentially equalize. Then, the fluid 36 flow slowly passes through the second flow restrictor 112A, through the pressure relief valve 108A, through the outlet exhaust 108A and into the exhaust reservoir 54. Generally, the fluid 36 included in the fluid exhaust reservoir 54 is air, however, any suitable fluid 36 (e.g., water or nitrogen) can be used. The pressure relief valve 108A determines the final pressure level of the fluid 36 in the pressure zones "E" and "F." Therefore, a patient resting upon the pressure zones "E" and "F" will be slowly and safely lowered to a level position with a selected support pressure.

Figure 3:
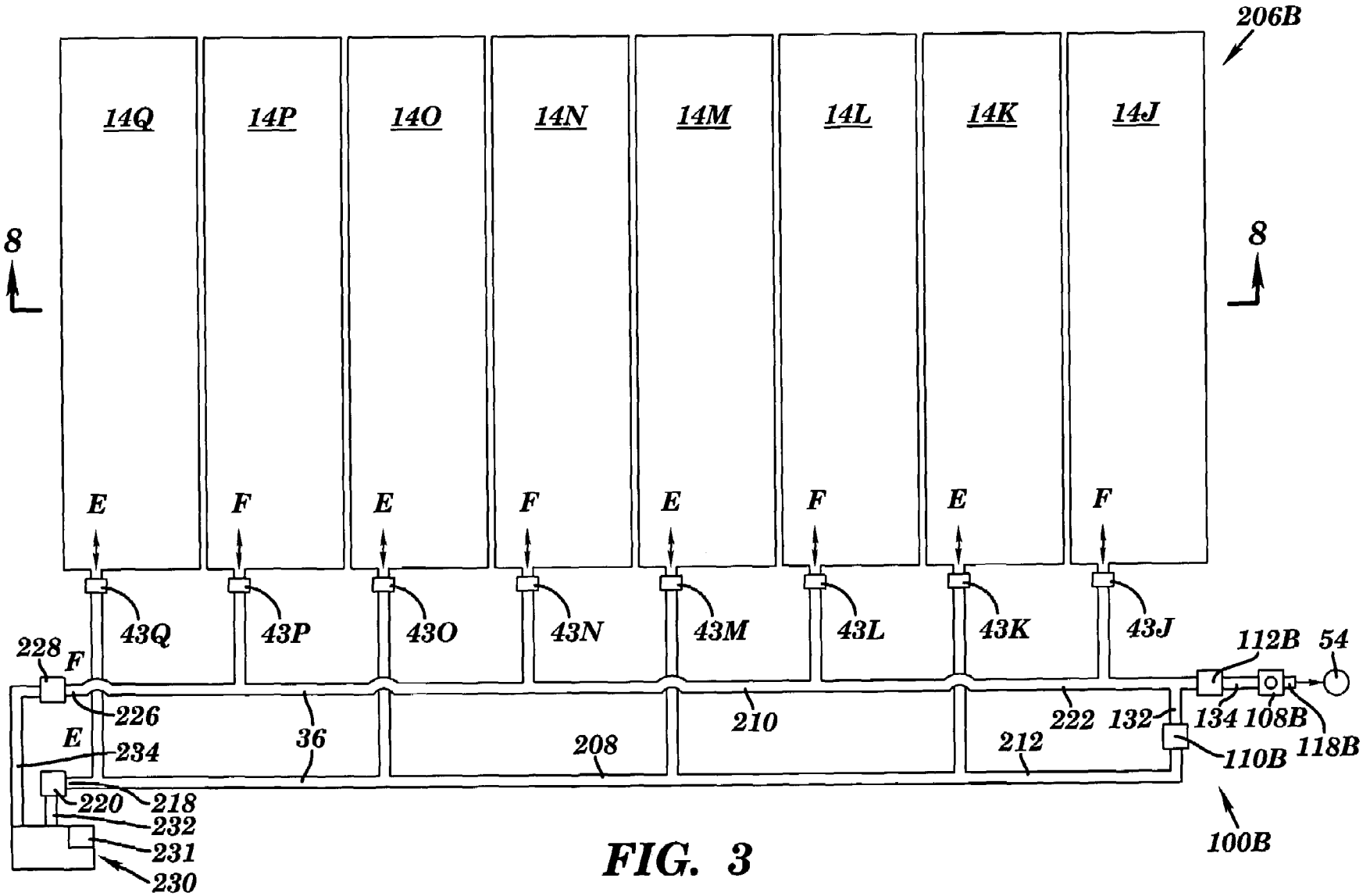
FIG. 3 illustrates a plan view of another embodiment of the support system apparatus including the equalizing pressure control system.

FIG. 3 illustrates another embodiment of the support system apparatus 206B. The support system apparatus 206B is similar to the support system apparatus 206A (FIG. 2), except the support system apparatus 206B has eliminated the intake valves 40F-40Q. The support system apparatus 206B includes an equalizing pressure control system 100B. The alternating pressure system 230 supplies alternating high and low pressure fluid 36 to conduit 208 and 210. When conduit 232 is connected to the shut off valve 220, and conduit 234 is connected to shut off valve 228, the alternating pressure is supplied to conduits 208 and 210. The conduits 208 and 210 supply the alternating fluid 36 to pressure zones "E" and "F." The alternating pressure system 230 can include any means for supplying the fluid 36 under pressure including a pump, compressor, etc. Also, included in the alternating pressure system 230 is any means such as a valve (not shown) for periodically switching the pressurized fluid 36 between conduit 232 and 234.

The ports 43Q, 43O, 43M, and 43K in zone "E" are connected to conduit 208. The ports 42J, 43L, 43N, and 43P in zone "F" are connected to conduit 210. The equalizing pressure control system 100B includes a first flow restrictor 110B, a second flow restrictor 112B, a pressure relief valve 108B, and an outlet conduit 118B. The first end 212 of conduit 208 is connected to the first flow restrictor 110B. The first end 222 of conduit 210 is connected to the second flow restrictor 112B. A conduit 132 connects the second flow restrictor 112B with the first end 222 of the conduit 210. A conduit 134 connects the second flow restrictor 112B with the pressure relief valve 108B. The outlet conduit 118B is connected with the exhaust reservoir 54. The pressure control level of the pressure relief valve 108B may be manually adjusted or may be preselected.

The alternating fluid 36 flow provided by the alternating pressure system 230 to pressure zones "E" and "F" is much higher than the flow passing between the pressure zones "E" and "F" through the first flow restrictor 110B. The alternating fluid 36 flow provided by the alternating pressure system 230 is much higher than the flow passing out through the second flow restrictor 112B. Preferably, the first flow restrictor 110B has a flow diameter of about 0.016 inches. The second flow restrictor 112B preferably has a flow diameter of about 0.004 inches. The second flow restrictor 112B has a flow diameter smaller than the flow diameter of the first flow restrictor 110B. Therefore, while pressurized alternating fluid 36 flow is being supplied between pressure zone "E" and pressure zone "F," the flow through the first flow restrictor 110B and the second flow restrictor 112B is so small that there is a negligible effect on the differential pressure between the pressure zone "E" and the pressure zone "F."

If the alternating pressure system 230 should be turned off or should fail, the fluid 36 will slowly flow through the first flow restrictor 110A between the pressure zone "E" and the pressure zone "F." The second flow restrictor 112B has a much smaller flow diameter than the flow diameter of restrictor 110B, so that the pressure in the pressure zone "E" and the pressure in the pressure zone "F" will essentially equalize. Then, the fluid 36 flow slowly passes through the second flow restrictor 112B, through the pressure relief valve 108B, through the outlet exhaust 118B and into the fluid exhaust reservoir 54. Generally, the fluid 36 included in the fluid exhaust reservoir 54 is air, however, any suitable fluid 36 (e.g., water or nitrogen) can be used. The pressure relief valve 108B determines the final pressure level of the fluid 36 in the pressure zones "E" and "F." Therefore, a patient resting upon the pressure zones "E" and "F" will be slowly and safely lowered to a level position with a selected support pressure.

Figure 4:
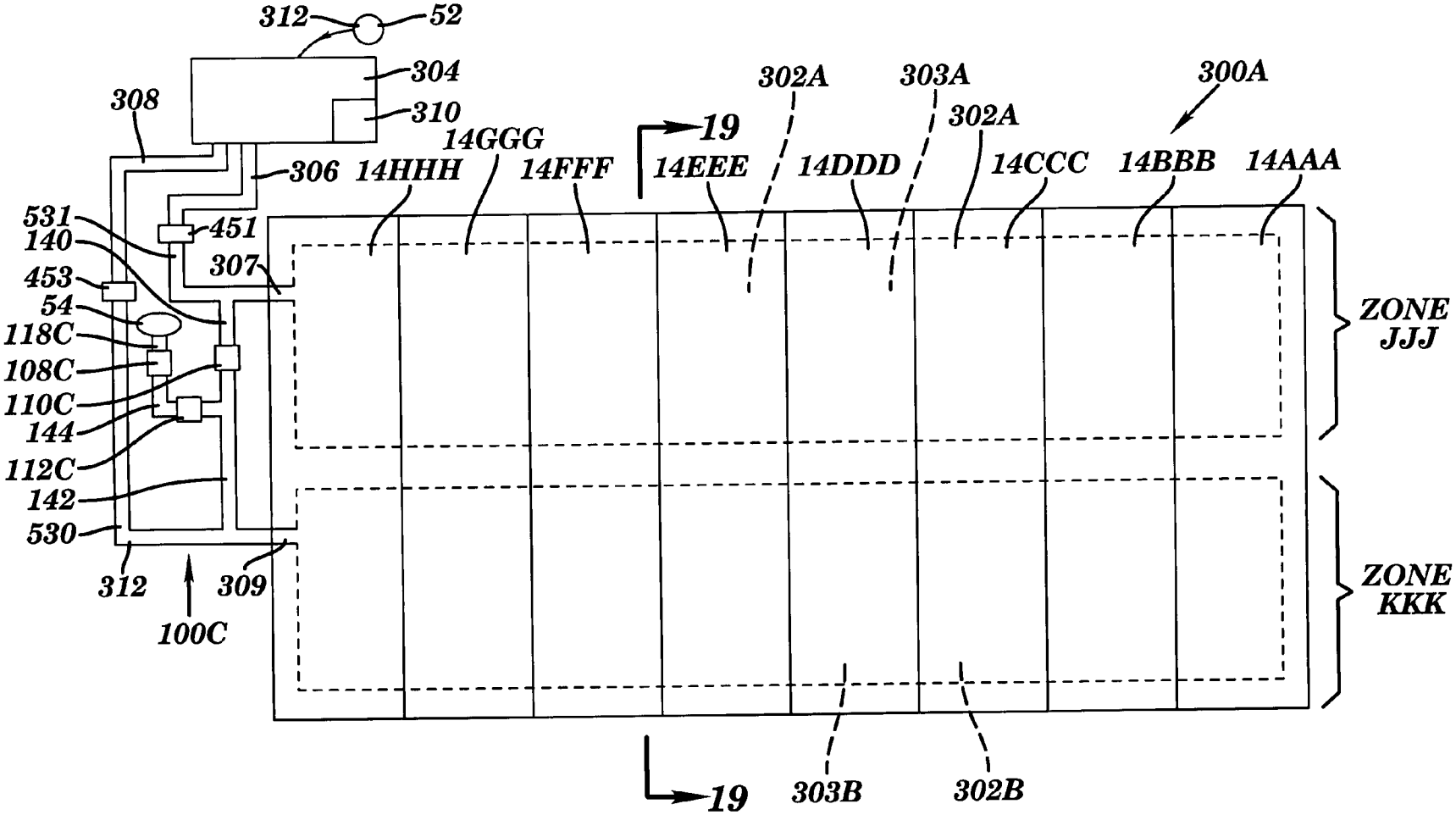
FIG. 4 illustrates a plan view of another embodiment of the support system apparatus including lifting pods and the equalizing pressure control system.

FIG. 4 illustrates a plan view of another embodiment of support system apparatus 300A including lifting pods 302A and 302B. The support apparatus 300A includes an equalizing control system 100C. The lifting pods 302A and 302B include bladders 303A and 303B, respectively, for containing a fluid 312. The support cells 14AAA-14HHH lie above the lifting pods 302A and 302B. The conduit 531 connects the port 307 in the bladder 303A of the lifting pod 302A with the connector 451. The conduit 306 connects the connector 451 with the pressure apparatus 304. The connector 451 may be a "quick disconnect" type that allows fluid 312 to flow through the connector 451 when the conduit 306 is connected, and prevents any flow of fluid 312 when the conduit 306 is disconnected.

The conduit 530 connects the port 309 in the bladder 303B of the lifting pod 302B with a connector 453. The connector 453 may also be a "quick disconnect" type that allows fluid 312 to flow through the connector 453 when the conduit 308 is connected, and prevents any flow of the fluid 312 when the conduit 308 is disconnected.

The pressure apparatus 304 may include, for example, a hand pump, a powered pump, or a compressor to provide pressurized fluid 312 to each of the conduits 306 and 308. The pressure apparatus 304 is supplied with fluid 312 from the fluid supply reservoir 52. The controller 310 selectively controls the application of the pressurized fluid 312 to the conduits 306 and 308. For example, pressurized fluid 312 may be selectively applied to the conduit 308. The fluid 312 flows from the pressure apparatus 304 through the conduit 308, the connector 453, the conduit 530, and through the port 309 into the bladder 303B of the lifting pod 302B. The lifting pod 302B inflates and lifts the portion of the support cells 14AAA-14HHH lying in a zone "KKK".

Similarly, pressurized fluid 312 may be selectively applied to conduit 306. In this case the fluid 312 flows from the pressure apparatus 304 through the conduit 306, the connector 451, the conduit 531, and through the port 307 into the bladder 303A of the lifting pod 302A. The lifting pod 302A inflates and lifts the portion of the support cells 14AAA-14HHH lying in the zone "JJJ."

The equalizing pressure control system 100C includes a first flow restrictor 110C, a second flow restrictor 112C, a pressure relief valve 108C, and an outlet conduit 118C. A conduit 140 connects the conduit 531 with the first flow restrictor 110C. A conduit 142 connects the conduit 312 with the first flow restrictor 110C and the second flow restrictor 112C. A conduit 144 connects the second flow restrictor 112C with the pressure relief valve 108C. The outlet conduit 118C connects the pressure relief valve 108C with the fluid exhaust reservoir 54.

Generally, the fluid 36 included in the fluid supply reservoir 52 and the fluid exhaust reservoir 54 is air, however, any suitable fluid 36 (e.g., water or nitrogen) can be used. The fluid supply reservoir 52 and the fluid exhaust reservoir 54 may comprise the same reservoir, and may comprise an ambient source of fluid 36 such as atmospheric air.

The first restrictor valve 110C prevents fluid 312 from quickly and easily passing between bladder 303A and 303B, so that fluid supplied by the pressure apparatus quickly flows into either bladder 303A or 303B. The first flow restrictor 110C has a flow diameter of about 0.016 inches. The second flow restrictor 112C has a diameter of about 0.004 inches. If the pressure apparatus 304 should be turned off or should fail, the fluid pressure in the bladders 303A and 303B is controlled by the equalizing pressure control system 100C. The fluid 312 will slowly flow through the first flow restrictor 110C between the bladder 303A and the bladder 303B. The second flow restrictor 112C has a much smaller flow diameter than the flow diameter of the first restrictor 110C, so that the pressure in the bladder 303A and the bladder 303B will equalize. Then, the fluid 312 flow slowly passes through the second flow restrictor 112C, through the pressure relief valve 108C, through the outlet exhaust 118C, and into the exhaust reservoir 54. The pressure relief valve 108C determines the final pressure level of the fluid 312 in the bladder 303A and the bladder 303B. Therefore, a patient tilted between the bladder 303A and the bladder 303B, will be slowly and safely lowered to a stable level position, and will be supported by a selected support pressure.

Figure 5:
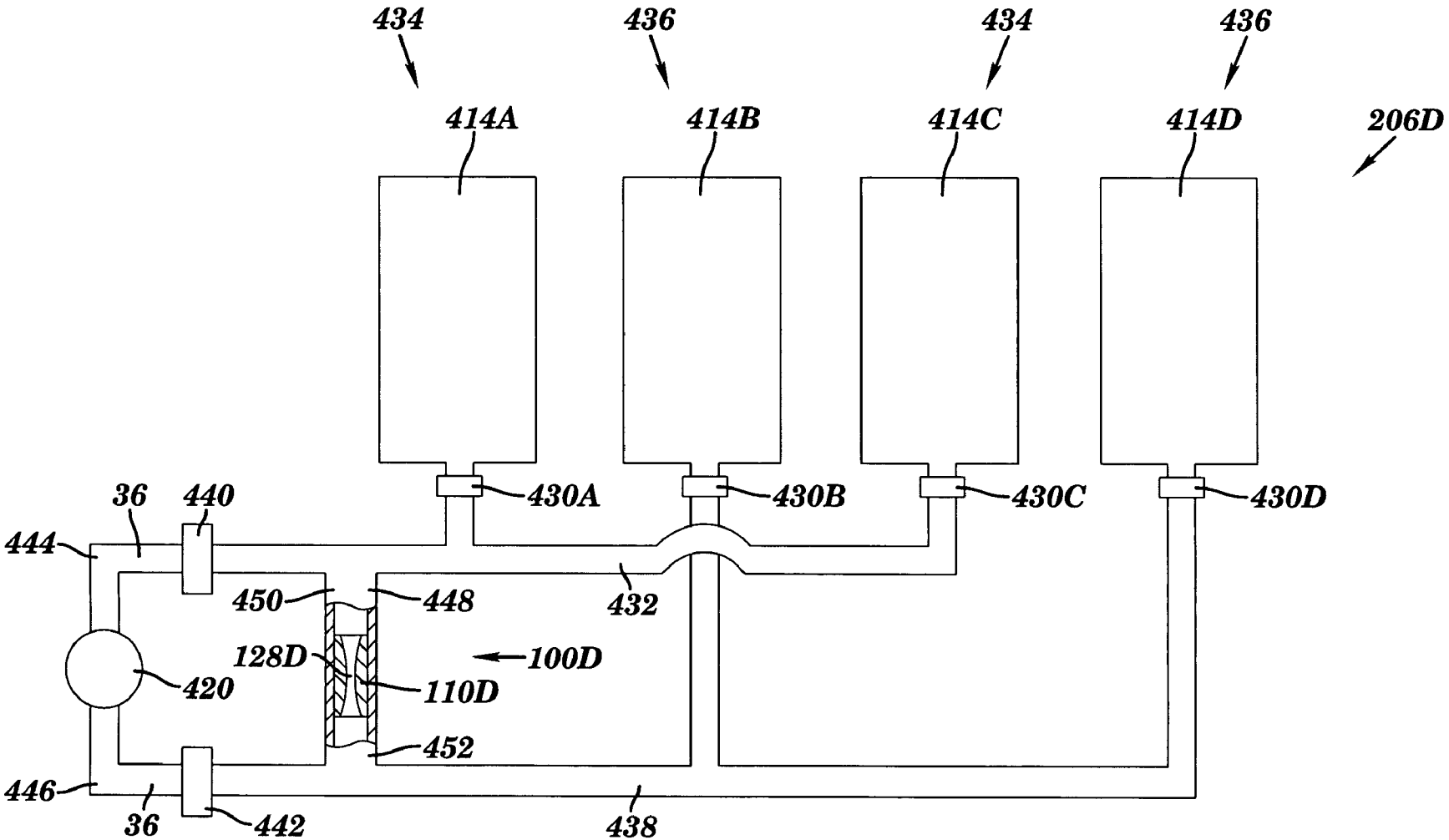
FIG. 5 illustrates a plan view of another embodiment of the support system apparatus including the equalizing pressure control system.

Another embodiment of a support system apparatus 206D is illustrated in FIG. 5. The support system apparatus 206D includes an equalizing pressure control system 100D. The support system apparatus 206D includes fluids cells 414A, 414B, 414C, and 414D. Fluid cells 414A and 414C include ports 430A and 430C, respectively. A first set of fluid cells 434 includes the fluid cells 414A and 414C. The ports 430A and 430C of the fluid cells 414A and 414C, respectively, are connected to a first manifold 432. The first set of fluid cells 434 may include one or any additional number of interconnected fluid cells 414 (not shown). Fluid cells 414B and 414D include ports 430B and 430D, respectively. A second set of fluid cells 436 includes the fluid cells 414B and 414D. The ports 430B and 430D of the fluid cells 414B and 414D, respectively, are connected to a second manifold 438. The second set of fluid cells 436 may include one or any additional number of interconnected fluid cells 414.

The first manifold 432 is connected to a valve 440. The second manifold 438 is connected to a valve 442. The valves 440 and 420 may be opened or closed for controlling the pressurized fluid 36 flow. A supply apparatus 420 supplies pressurized fluid 36. The supply apparatus 442 may include any suitable pressure generating apparatus (e.g., a hand pump, a powered pump, a compressor, a pressurized tank, etc.). Generally, the pressurized fluid 36 is air, however, any suitable pressurized fluid 36 (e.g., water, nitrogen, etc.) can be used.

The supply apparatus 420 is connected to a conduit 444 and a conduit 446. The conduit 444 is connected to the valve 440, and the conduit 446 is connected to the valve 442. When the valve 440 is opened, the supply apparatus 420 supplies pressurized fluid 36 through the conduit 444, through the first manifold 432, through the ports 430A and 430C, and into the first set of fluid cells 434 (fluid cells 414A and 414C). The valve 440 is closed when a desired pressure level is obtained in the first set of fluid cells 434.

When the valve 442 is opened, the supply apparatus 420 supplies pressurized fluid 36 through the conduit 446, through the second manifold 438, through the ports 430B and 430D, and into the second set of fluid cells 436 (fluid cells 414B and 414D). The valve 442 is closed when a desired pressure level is obtained in the second set of fluid cells 436. The pressure level in the first set of fluid cells 434 may be different from the pressure level in the second set of fluid cells 436. Additionally, alternating pressurized fluid 36 may be applied to the first set of fluid cells 434 and to the second set of fluid cells 436.

FIG. 5 illustrates a partial cross-sectional view of the equalizing pressure control system 100D. The equalizing pressure control system 100D includes a conduit 448, and a flow restrictor 110D. The flow restrictor 110D is located within the conduit 448. A first end 450 of the conduit 448 is connected to the first manifold 432, and a second end 452 of the conduit 448 is connected to the second manifold 438. Pressurized fluid 36 passes between the first manifold 432 and the second manifold 438 through the flow restrictor 110D. The flow restrictor 110D may restrict flow by any suitable means (e.g., orifice, porous material, etc.). The flow restrictor 110D may have a flow diameter 128D of about 0.016 inches. The flow restrictor 110D is sized so that when pressurized fluid 36 is being supplied to the first set of fluid cells 434 and to the second set of fluid cells 436, the flow between the first set of fluid cells 434 and the second set of fluid cells 436, is so small that there is a negligible effect on the differential pressure between the first set of fluid cells 434 and the second set of fluid cells 436.

When the valves 440 and 442 are shut off, the pressurized fluid 36 is trapped in the first set of fluid cells 434 and in the second set of fluid cells 436. If the pressure level is different between the first set of fluid cells 434 and the second set of fluid cells 436, then the equalizing pressure control system 110D slowly equalizes the fluid pressure between the first set of fluid cells 434 and the second set of fluid cells 436. The pressurized fluid 36 slowly flows between the first set of fluid cells 434 and the second set of fluid cells 436 through the flow restrictor 110D until all the fluid cells 414A-414D contain equal pressure. Therefore, a patient resting upon the first set of fluid cells 434 and the second set of fluid cells 436 will be slowly and safely lowered to a stable level position.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

The claims are as follows:

1. A body support comprising:

a plurality of fluid cells forming at least a first pressure zone and a second pressure zone;

at least one manifold system connected to each pressure zone, and interconnected to said plurality of fluid cells;

an equalizing pressure control system operatively attached to the at least one manifold system, said equalizing pressure control system including at least one flow restrictor operatively attached between each pressure zone, and a pressure relief valve that is operatively attached to all of the pressure zones, wherein said equalizing pressure control system allows the equalization of the fluid pressure between the first pressure zone including at least one fluid cell and the second pressure zone including at least one fluid cell, wherein a fluid may flow through said flow restrictor in both directions, and wherein the flow through said flow restrictor has a negligible effect on the differential pressure between the first pressure zone and the second pressure zone when pressurized fluid is being supplied to said fluid cells.

2. The body support of claim 1, wherein at least one of said flow restrictors is an orifice.

3. The body support of claim 1, further comprising a plurality of manifold systems, each with an interconnected group of fluid cells.

4. The body support of claim 3, wherein the plurality of manifold systems further comprises:

a plurality of conduits;

a port connected to the plurality of conduits; and a shut off valve connecting the plurality of conduits to an alternating fluid pressure system.

5. The body support of claim 1, wherein the plurality of fluid cells further include an intake valve providing pressurized fluid from an intake control system, wherein the intake control system is connected to each of the plurality of fluid cells by at least one conduit.

6. The body support of claim 1, wherein at least one of said flow restrictors is a porous material.

7. An apparatus comprising:

a set of fluid cells;

at least two manifold systems each connected to non-adjacent cells, each manifold system with an interconnected set of fluid cells;

a supply apparatus for supplying pressurized fluid to at least one interconnected set of fluid cells; and an equalizing pressure control system operatively connected with between the at least two manifold systems for equalizing the fluid pressure in each fluid cell, wherein the equalizing pressure control system includes a pressure relief valve operatively attached and adjacent to at least one flow restrictor, such that a fluid may flow through said flow restrictor in both directions, wherein the flow restrictor is positioned in a conduit that connects the at least two manifold systems together adjacent to the supply apparatus, wherein the flow through said flow restrictor has a negligible effect on the differential pressure between a first pressure zone and a second pressure zone when pressurized fluid is being supplied to said fluid cells, and wherein the pressure relief valve may be adjusted to select a level of fluid pressure in the manifold systems.

8. The body support of claim 7, wherein at least one of said flow restrictors is a porous material.

9. The apparatus of claim 7, wherein the supply apparatus supplies pressurized fluid to each interconnected set of fluid cells.

10. The apparatus of claim 7, wherein the supply apparatus further includes a device selected from the group consisting of a hand pump, a powered pump, a compressor, and a pressurized tank to provide pressurized fluid to each interconnected set of fluid cells.

11. The body support of claim 7, wherein at least one of said flow restrictors is an orifice.

12. A body support comprising:

a plurality of fluid cells;

at least one manifold system, interconnected to said plurality of fluid cells;

an equalizing pressure control system operatively attached to the at least one manifold system, said equalizing pressure control system including at least one flow restrictor, said at least one manifold being operatively attached to a pressure relief valve, wherein said equalizing pressure control system allows the equalization of the fluid pressure between a first pressure zone including at least one fluid cell and a second pressure zone including at least one fluid cell, wherein a fluid may flow through said flow restrictor in both directions between pressure zones, and wherein the flow through said flow restrictor has a negligible effect on the differential pressure between the first pressure zone and the second pressure zone when pressurized fluid is being supplied to said fluid cells; and an alternating fluid pressure system applying alternating fluid pressure to the manifold system.

13. A body support comprising:

a plurality of fluid cells;

at least one manifold system, interconnected to said plurality of fluid cells;

an equalizing pressure control system operatively attached to the at least one manifold system, said equalizing pressure control system including at least one flow restrictor operatively attached to a pressure relief valve, wherein said equalizing pressure control system allows the equalization of the fluid pressure between a first pressure zone including at least one fluid cell and a second pressure zone including at least one fluid cell, wherein a fluid may flow though said flow restrictor in both directions, and wherein the flow though said flow restrictor has a negligible effect on the differential pressure between the first pressure zone and the second pressure zone when pressurized fluid is being supplied to said fluid cells;

a plurality of manifold systems, each with an interconnected group of fluid cells;

a plurality of flow restrictors;

a first flow restrictor connecting the plurality of manifold systems for restricting a flow of fluid between the plurality of manifold systems;

a second flow restrictor connecting the first flow restrictor with the pressure relief valve, and wherein the second flow restrictor provides a greater flow resistance to the fluid than the first flow restrictor, and wherein the pressure relief valve selects a level of fluid pressure in the plurality of manifold systems.

14. An apparatus comprising:

a first conduit operatively attached to a body support having a first pressure zone;

a second conduit operatively attached to a body support having a second pressure zone;

a third conduit, interconnecting the first conduit and the second conduit;

a fluid supply for supplying pressurized fluid through the first conduit to the first pressure zone and through the second conduit to the second pressure zone, wherein said first pressure zone said second pressure zone have a pressure differential during operation; and a first flow restrictor, operatively attached to said third conduit, said flow restrictor being sized such that during operation of the fluid supply, fluid flow between the first pressure zone and the second pressure zone is negligible and when the fluid supply is shut off, fluid may flow between the first pressure zone and the second pressure zone to equalize the pressure differential between the first pressure zone and the second pressure zone; and a second flow restrictor connecting the first flow restrictor with a pressure relief valve and wherein the second flow restrictor provides a greater flow resistance to the fluid than the first flow restrictor.

15. The apparatus of claim 14, wherein the flow restrictor is sized to a diameter of about 0.016 inches.

16. The apparatus of claim 14, wherein the flow restrictor is sized to a diameter of about 0.004 inches.

17. A body support comprising:

a plurality of inflatable cushioning devices;

an input for a supply of pressurized fluid, a single manifold operatively attached to each of said plurality of inflatable cushioning devices;

a check valve positioned between said supply of pressurized fluid and each of said cushioning devices; and an equalizing pressure control system attached to at least one flow restrictor and said plurality of cushioning devices, such that a fluid may flow through said flow restrictor in both directions, wherein said equalizing pressure control system lowers a patient if the supply of pressurized fluid is turned off or fails.

18. A body support comprising:

a plurality of bladders;

a supply apparatus for supplying a pressurized fluid to each bladder;

an equalizing pressure control system for controlling the pressurized fluid in the plurality of bladders when the supply apparatus is removed or shut off, wherein the equalizing pressure control system equalizes the fluid pressure in each bladder to a selected pressure level and includes a first flow restrictor connecting the plurality of bladders, and a second flow restrictor having a greater flow resistance than said first flow restrictor, wherein fluid may flow through said first and second flow restrictors in both directions, and wherein said second flow restrictor connects said first flow restrictor with a pressure relief valve, and wherein the pressure relief valve may be adjusted to select a level of fluid pressure in the plurality of bladders.

19. The body support of claim 18, wherein at least one of said first and second flow restrictors is a porous material.

20. The body support of claim 18, wherein the supply apparatus further includes a device selected from the group consisting of: a hand pump, a powered pump, a compressor, to provide pressurized fluid to the plurality of bladders.

21. The body support of claim 18, wherein the supply apparatus further includes a controller to selectively control the level of pressurized fluid provided to the plurality of bladders.

22. The body support of claim 18, wherein the pressurized fluid comprises a material selected from the group consisting of: water and nitrogen.

23. The body support of claim 18, wherein at least one of said first and second flow restrictors is an orifice.

24. A method comprising the steps of:

providing a first fluid cell filled with a fluid at a first fluid pressure level;

providing a second fluid cell filled with the fluid at a second fluid pressure level;

providing a restrictor in a conduit between the first fluid cell and the second fluid cell;

equalizing the fluid pressure between the first fluid cell and the second fluid cell to a third pressure level; and adjusting the third pressure level to a fourth pressure level.

25. The method of claim 24, wherein the step of equalizing the fluid pressure between the first and second fluid cell is accomplished using an equalizing pressure control system.

26. The method of claim 25, wherein the equalizing pressure control system includes a first flow restrictor connected between the first fluid cell and the second fluid cell.

27. The method of claim 24, wherein a pressure relief valve selects the fourth pressure level.

28. The method of claim 24, wherein the step of adjusting the third pressure level to the fourth pressure level is accomplished using a second flow restrictor.

29. A body support comprising:

a plurality of fluid cells;

a plurality of manifold systems, interconnected to said plurality of interconnected fluid cells; and an equalizing pressure control system operatively attached to the plurality of manifold systems, said equalizing pressure control system including at least two flow restrictors and a pressure relief valve, such that a fluid may flow through said flow restrictors in both directions, wherein a first flow restrictor allows the equalization of the fluid pressure between a first group of fluid cells and a second group of fluid cells, wherein a second flow restrictor connects the first flow restrictor with said pressure relief valve, and wherein the second flow restrictor provides a greater flow resistance to the fluid than the first flow restrictor, and wherein the pressure relief valve selects a level of fluid pressure in the plurality of manifold systems.

* * * * *